US010381782B2

(12) United States Patent
Byrne et al.

(10) Patent No.: US 10,381,782 B2
(45) Date of Patent: Aug. 13, 2019

(54) ELECTRICAL CONNECTOR WITH HAPTIC FEEDBACK

(71) Applicants: Norman R. Byrne, Ada, MI (US); Daniel P. Byrne, Lowell, MI (US); Timothy J. Warwick, Sparta, MI (US); Thomas A. Petersen, Sand Lake, MI (US); Randell E. Pate, Jenison, MI (US); Marc A. Mitchell, Belmont, MI (US)

(72) Inventors: Norman R. Byrne, Ada, MI (US); Daniel P. Byrne, Lowell, MI (US); Timothy J. Warwick, Sparta, MI (US); Thomas A. Petersen, Sand Lake, MI (US); Randell E. Pate, Jenison, MI (US); Marc A. Mitchell, Belmont, MI (US)

( * ) Notice: Subject to any disclaimer, the term of this patent is extended or adjusted under 35 U.S.C. 154(b) by 0 days.

(21) Appl. No.: 16/004,761

(22) Filed: Jun. 11, 2018

(65) Prior Publication Data

US 2018/0358749 A1 Dec. 13, 2018

Related U.S. Application Data

(60) Provisional application No. 62/518,213, filed on Jun. 12, 2017.

(51) Int. Cl.

| | |
|---|---|
| ***H01R 13/60*** | (2006.01) |
| ***H01R 13/641*** | (2006.01) |
| ***H01R 13/62*** | (2006.01) |
| ***H01R 25/00*** | (2006.01) |

(52) U.S. Cl.
CPC ..... *H01R 13/641* (2013.01); *H01R 13/6205* (2013.01); *H01R 25/006* (2013.01)

(58) Field of Classification Search
CPC . H01R 13/641; H01R 25/006; H01R 13/6205
USPC ..... 439/39, 107, 620.05
See application file for complete search history.

(56) References Cited

U.S. PATENT DOCUMENTS

| | | | | |
|---|---|---|---|---|
| 2,170,287 | A | 6/1937 | Kinnebrew | |
| 3,363,214 | A | 1/1968 | Wright | |
| 3,588,039 | A * | 6/1971 | Chelminski | F16K 31/0648 181/120 |
| 3,808,577 | A | 4/1974 | Mathauser | |
| 3,810,258 | A | 5/1974 | Mathauser | |
| 3,816,679 | A | 6/1974 | Hotchkiss | |
| 4,112,941 | A | 9/1978 | Larimore | |
| 4,242,657 | A | 12/1980 | Chaillot | |
| 4,544,903 | A | 10/1985 | Grant | |
| 5,015,061 | A | 5/1991 | Giannini | |
| 5,244,415 | A | 9/1993 | Marsilio et al. | |
| 5,346,406 | A | 9/1994 | Hoffman et al. | |

(Continued)

*Primary Examiner* — Abdullah A Riyami
*Assistant Examiner* — Nelson R. Burgos-Guntin
(74) *Attorney, Agent, or Firm* — Gardner, Linn, Burkhart & Ondersma LLP

(57) ABSTRACT

An electrical connector including first and second connector parts configured for mating together, and with one of the connector parts having a sensory feedback member that moves between an extended position and a retracted position as a result of magnetic interaction with an actuation element in the other connector part during mating of the connector parts. The movement of the sensory feedback member causes a sensory feedback indication, such as an audible sound or a tactile vibration.

20 Claims, 8 Drawing Sheets

(56) References Cited

U.S. PATENT DOCUMENTS

| | | | | |
|---|---|---|---|---|
| 5,829,987 | A | 11/1998 | Fritsch et al. | |
| 7,311,526 | B2 | 12/2007 | Rohrbach et al. | |
| 7,329,128 | B1 | 2/2008 | Awad | |
| 7,331,793 | B2 | 2/2008 | Hernandez et al. | |
| 7,351,066 | B2 | 4/2008 | DiFonzo et al. | |
| 7,645,143 | B2 | 1/2010 | Rohrbach et al. | |
| 7,771,202 | B2 | 8/2010 | Amotz et al. | |
| 7,901,216 | B2 | 3/2011 | Rohrbach et al. | |
| 7,909,638 | B2 | 3/2011 | Seo et al. | |
| 8,087,939 | B2 | 1/2012 | Rohrbach et al. | |
| 8,398,409 | B2 | 3/2013 | Schmidt | |
| 8,435,042 | B2 | 5/2013 | Rohrbach et al. | |
| 8,602,795 | B2 | 12/2013 | Hsu | |
| 8,690,582 | B2 | 4/2014 | Rohrbach et al. | |
| 8,951,248 | B2 * | 2/2015 | Messerly | A61B 17/320092 606/34 |
| 9,077,105 | B2 | 7/2015 | Kim | |
| 9,083,110 | B2 | 7/2015 | McClelland | |
| 9,147,965 | B2 | 9/2015 | Lee | |
| 9,225,126 | B2 | 12/2015 | Janfada et al. | |
| 9,431,182 | B2 | 8/2016 | Kim et al. | |
| 9,531,118 | B2 | 12/2016 | Byrne et al. | |
| 2011/0159706 | A1 | 6/2011 | Wu | |
| 2014/0120746 | A1 | 5/2014 | Persion et al. | |
| 2015/0357753 | A1 | 12/2015 | Lee | |
| 2016/0336695 | A1 | 11/2016 | Janfada et al. | |
| 2017/0102424 | A1 * | 4/2017 | Maalouf | G01R 31/045 |
| 2017/0110827 | A1 * | 4/2017 | Finona | H01R 11/30 |
| 2017/0125949 | A1 * | 5/2017 | Saur | H01R 13/4361 |
| 2017/0194739 | A1 * | 7/2017 | Park | H01R 13/6205 |
| 2018/0358749 | A1 * | 12/2018 | Byrne | H01R 13/6205 |

* cited by examiner

ELECTRICAL CONNECTOR WITH HAPTIC FEEDBACK

CROSS-REFERENCE TO RELATED APPLICATIONS

The present application claims the filing benefits of U.S. provisional application Ser. No. 62/518,213, filed Jun. 12, 2017, which is hereby incorporated by reference herein in its entirety.

FIELD OF THE INVENTION

The present invention relates to electrical power and/or electronic data outlets, receptacles, and connectors for establishing establish direct electrical connections between respective electrical conductors.

BACKGROUND OF THE INVENTION

Many different types of electrical and electronic data connectors have been devised for transmitting electrical power or electrical signals from one or more electrical conductors to another one or more electrical conductors. For example, male-to-female electrical connections are commonly used to establish proper connections for compatible conductors, whether for power or data signal transmission. While connectors are frequently provided at the ends of respective flexible cords, in some applications such as work area environments it is desirable to rigidly or semi-rigidly mount connectors to another object or surface, such as an article of furniture or a wall or floor surface. However, rigidly or semi-rigidly mounted connectors present challenges such as proper alignment of one connector with another connector.

SUMMARY OF THE INVENTION

The present invention provides an electrical power or electronic data coupling that utilizes magnets or a combination of magnets and magnetically permeable materials to provide sensory feedback to a user once a first connector part is substantially fully mated with a second connector part. The sensory feedback, which may be in the form of a "click" sound and/or vibration, indicates to the user that at least an initial alignment and connection has been properly established between the parts of the electrical power or data coupling. The sensory feedback may occur well prior to the parts of the electrical power or data coupling becoming fully mated, or may occur just before or substantially simultaneously with the electrical power or data coupling becoming fully mated.

According to one form of the invention, an electrical connector includes first and second connector parts that are configured for mating engagement with one another, plus a sensory feedback member and an actuation element. Each connector part may have at least one electrical contact or other type of interface that is configured to engage a contact or interface of the other connector part. The sensory feedback member is mounted at the second connector part and is movable between a retracted position and an extended position. The sensory feedback member is made from a magnetically permeable material such as a permanent magnet or a ferrous material that is attracted to a permanent magnet. The actuation element is located at the first connector part and is also made from a magnetically permeable material so that the actuation element and the sensory feedback member are magnetically interactive with one another (i.e. attractive or repellant). The actuation element is configured to force the sensory feedback member to move between the retracted position and the extended position upon mating engagement of the first and second connector parts.

In one aspect, the actuation element and/or the sensory feedback member is a permanent magnet, so that the actuation element and the sensory feedback member are magnetically interactive.

In another aspect, the sensory feedback member generates an audible sound or a tactile sensation upon moving between the retracted position and the extended position.

In yet another aspect, the actuation element is configured so that it forces the sensory feedback member to move between the retracted position and the extended position only after the electrical contacts of the first and second connector parts establish electrical continuity, when the connector parts are being coupled.

In still another aspect, the actuation element is disposed in a central region of the first connector part, which has a pair of the electrical contacts on opposite sides of the actuation element, and the sensory feedback member is disposed in a central region of the second connector part, which has a pair of the electrical contacts on opposite sides of the sensory feedback member.

In a further aspect, the second connector part includes a hollow chamber formed behind the actuation element, for selectively receiving a rear portion of the actuation element as it moves to the retracted position.

In a still further aspect, a biasing member is positioned at a rear end of the hollow chamber in the second connector part. The biasing member is configured to cause the sensory feedback member to move to the retracted position when the first and second connector parts are not mated.

In another aspect, the biasing member and the actuation element are both permanent magnets, the actuation element has a greater magnetic field strength than a magnetic field strength of the biasing member, and the magnetic field strength of the actuation element is sufficient to overcome the magnetic field strength of the biasing member to move the sensory feedback member to the extended position upon mating of the connector parts.

Therefore, the electrical power or electronic data coupling of the present invention provide sensory feedback to a user as an indication that a first connector part is initially mated and aligned with a second connector part, or that the first and second connector parts are more fully mated. The sensory feedback is typically an audible sound and/or vibratory sensation that can be detected through the user's fingers while pushing the connector parts together, and provides a clear indication to the user that the connector parts have established a desired connection.

These and other objects, advantages, purposes and features of the present invention will become apparent upon review of the following specification in conjunction with the drawings.

DESCRIPTION OF THE PREFERRED EMBODIMENTS

Figure 1A:
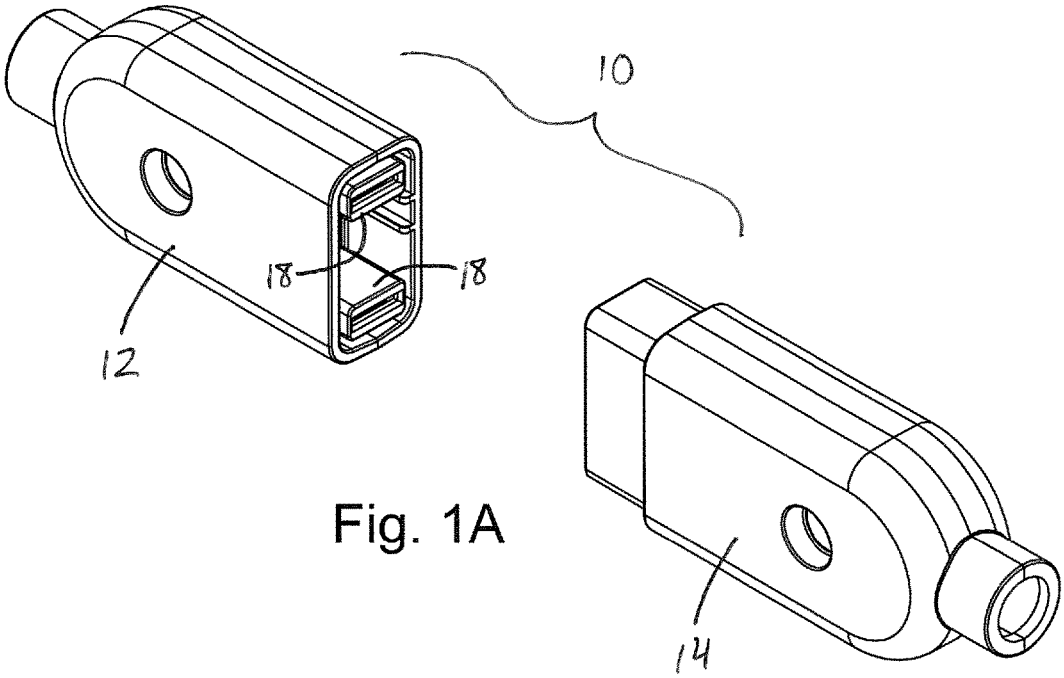
FIG. 1A is a perspective view of a pair of compatible electrical connector parts of an electrical connector in accordance with the present invention, shown spaced apart.

Referring now to the drawing and the illustrative embodiments depicted therein, an electrical connector 10, which may be characterized as an electrical plug and receptacle arrangement, provides sensory feedback to a user when a connection is initially or sufficiently or fully established between a first or female connector part 12 and a second or male connector part 14, such as shown in FIGS. 1A-2B. The mechanical connection between the connector parts 12, 14 is primarily established and held by friction, although one or more permanent magnets and one or more magnetically permeable materials, such as ferrous metal, permanent magnets, or the like, may serve to further maintain and stabilize the connection, as will be described below. The sensory feedback results from the movement of one of the magnetically permeable materials, inside one of the connector parts 12, 14, in reaction to the alignment and proximity of another magnetically permeable material in the other connector part, and may be in the form of a tactile or haptic sensation that is sensed through the fingertips, and/or an audible "click" or similar tone, although other types of sensory feedback are also possible. Electrical connector 10 can be used for high voltage AC electrical connections, low voltage DC electrical connections, electronic signal connections, and for applications including daisy-chaining modular electrical systems together. It is further envisioned that the principles of the present invention may be applied to fluid line connectors such as for conveying medical fluids, including gases, from a source connector to a corresponding connector associated with one or more flexible fluid lines extending to a patient.

Figure 1B:
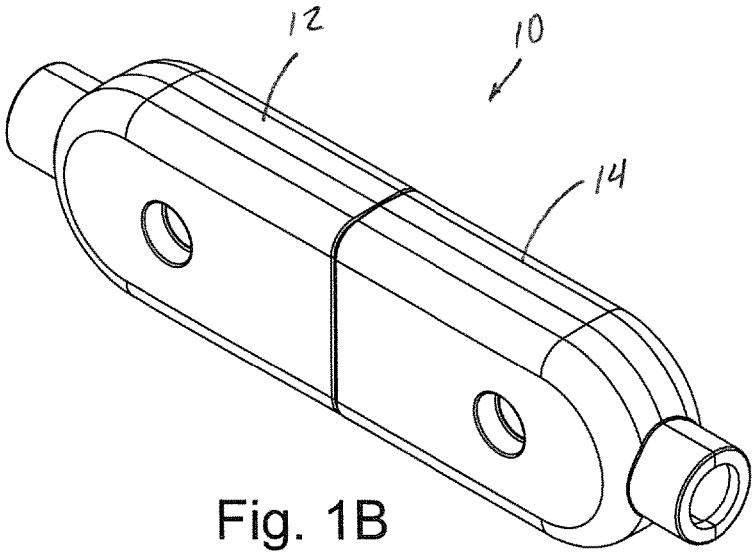
FIG. 1B is a perspective view of the connector parts of FIG. 1A, shown fully engaged.
Figure 2A:
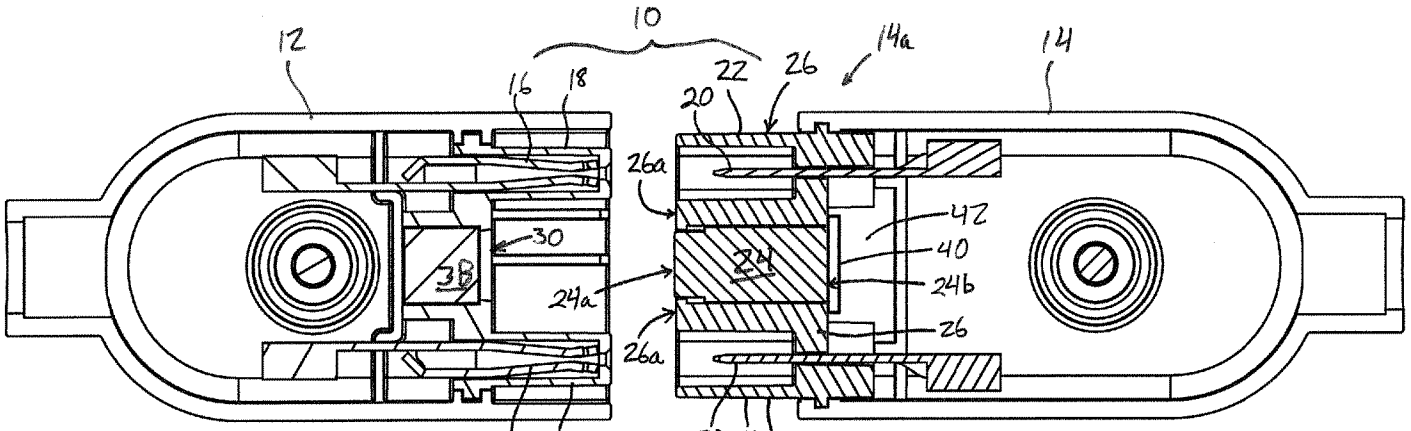
FIG. 2A is a sectional view of the electrical connector parts of FIG. 1A.
Figure 2B:
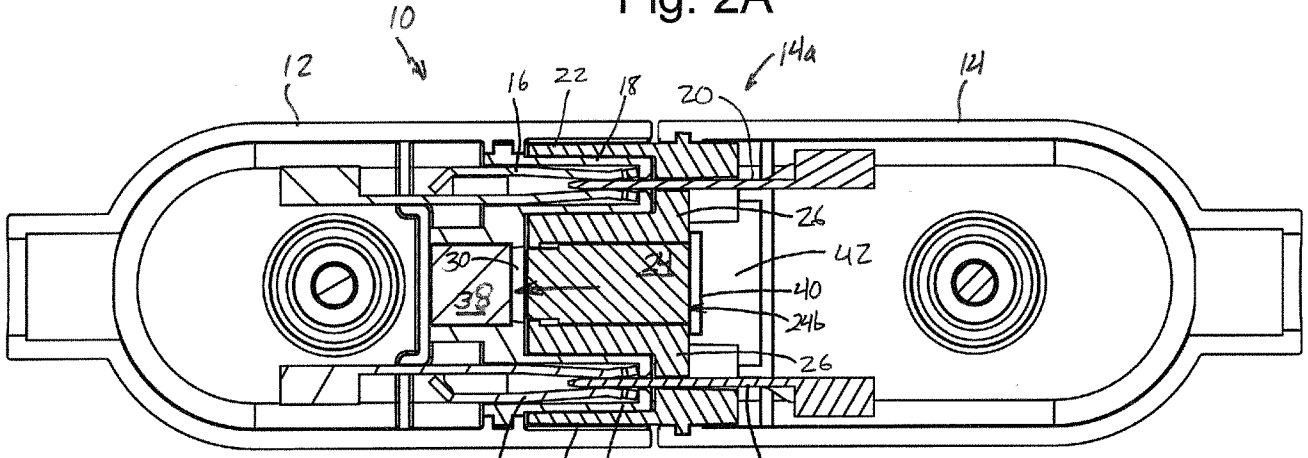
FIG. 2B is a sectional view of the electrical connector parts of FIG. 1B.

Female connector part 12 and male connector part 14 are configured for mating engagement with one another and, in the illustrated embodiment, each connector part 12, 14 has a respective and corresponding pair of electrical contacts. As best shown in FIGS. 2A and 2B, female connector part 12 includes a pair of spaced-apart female electrical contacts 16 contained within respective insulative contact housings 18, and male connector part 14 includes a pair of spaced-apart male electrical contacts 20 that are recessed within open insulative sleeves 22 that are sized and shaped to receive the insulative contact housings 18 of female connector part 12. Thus, when male and female connector parts 12, 14 are engaged as shown in FIGS. 1B and 2B, the female connector's insulative contact housings 18 engage the male connector's open insulative sleeves 22 just prior to the male electrical contacts 20 engaging the female electrical contacts 16. With this arrangement, male electrical contacts 20 are not electrically energized by female electrical contacts 16 until the male contacts 20 are completely surrounded by insulative material and become inaccessible to foreign objects.

A sensory feedback member 24 is movably mounted in a centrally-located sleeve 26 at a forward or mating end portion 14*a* of male connector part 14 (FIGS. 2A and 2B). Sleeve 26 also forms the male connector's open insulative sleeves 22. The sensory feedback member 24 is movable between a retracted position (shown) in which a forward surface 24*a* is substantially flush with a forward surface 26*a* of sleeve 26 and a rearward surface 24*b* engages a backstop 28, and an extended position in which forward surface 24*a* projects outwardly from forward surface 26*a* of sleeve 26, with forward surface 24*a* being received in a central opening 30 of female connector part 12 when the connector parts 12, 14 are assembled together. Although the extended position of the sensory feedback member 24 is not shown in FIG. 2B, an arrow overlying sensory feedback member 24 is used to indicate the sensory feedback member's travel to the extended position upon engagement of the connector parts 12, 14.

Figure 3:
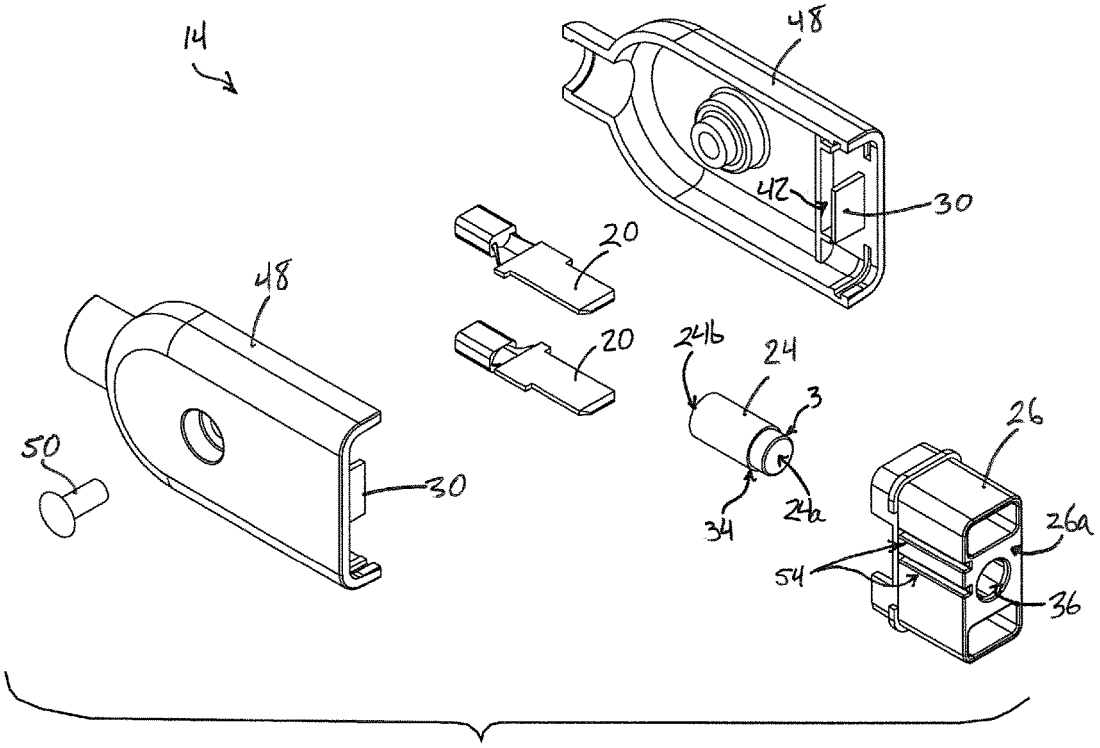
FIG. 3 is an exploded perspective view of the male connector part of the electrical connector.
Figure 4:
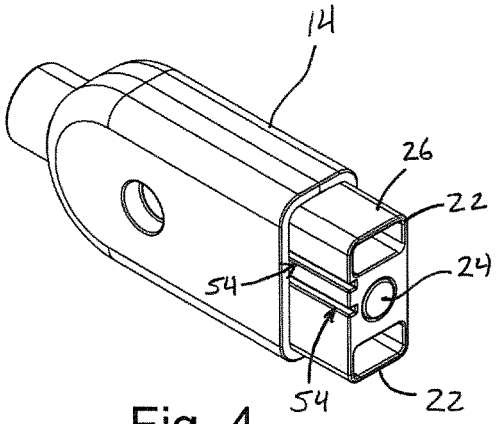
FIG. 4 is a perspective view of the male connector part of the electrical connector.

With reference to FIG. 3, sensory feedback member 24 has a reduced diameter region 32 at its forward end, thereby forming a shoulder 34 that contacts an inner shoulder or flange 36 of sleeve 26 to prevent further forward movement of sensory feedback member 24 beyond the extended position. The sudden contact between shoulder 34 and flange 36, and optionally combined with the substantially simultaneous sudden contact of forward surface 24 with an actuation element 38 in female connector part 12, results in a tactile or haptic sensation of a single-contact vibration, as in a "click" or "thunk", which may also coincide with an audible sound. The intensity (volume or amplitude) and sharpness or dullness of the sensation and/or sound of the sensory feedback member 24 reaching its fully extended position may be adjusted by the hardness of the materials making contact with one another, the mass of the sensory feedback member, the relative field strengths of magnets used, as well as the shapes of surrounding materials, which may be chosen in such a way that damps the sound and/or sensation to a greater or lesser degree, as desired for a given application.

A rearward end 24*b* of sensory feedback member 24 is drawn rearwardly against a backstop 40 by a biasing member in the form of a retraction magnet that is positioned in a chamber 42 defined behind backstop 30. The retraction magnet (not shown in FIGS. 2A-3) has sufficient magnetic field strength to cause sensory feedback member 24 to move to its retracted position when male connector 14 is not engaged with female connector 12. The actuation element 38 in the female connector part 12 is also a permanent magnet, and has a sufficiently greater magnetic field strength than the retraction magnet of male connector part 14 so that when sensory feedback member 24 is retracted and the connector parts 12, 14 are assembled properly together, the magnetic field of actuation element 38 overcomes the magnetic field of the retraction magnet acting upon sensory feedback member 24, thus causing sensory feedback member 24 to slide to its extended position with its forward end extending into the central opening 30 of female connector part 12. Depending on the relative magnetic field strengths of the permanent magnets, connector 10 can be configured so that sensory feedback member 24 moves to its extended position only when the connector parts 12, 14 are fully seated (or very nearly so), or at some earlier point during the mating process, such as once full electrical contact is made by the respective male and female contacts 20, 16.

Figure 3A:
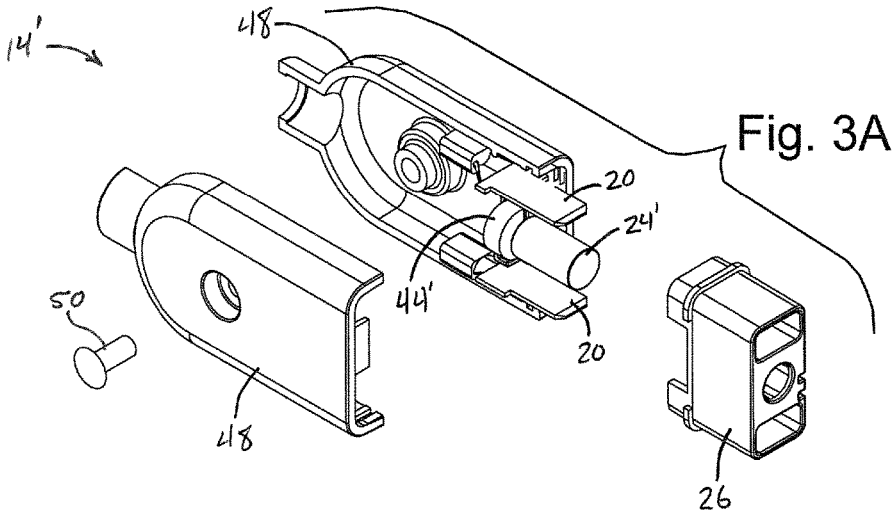
FIGS. 3A and 3B are partially exploded and fully exploded perspective views, respectively of an alternative male connector part.
Figure 3B:
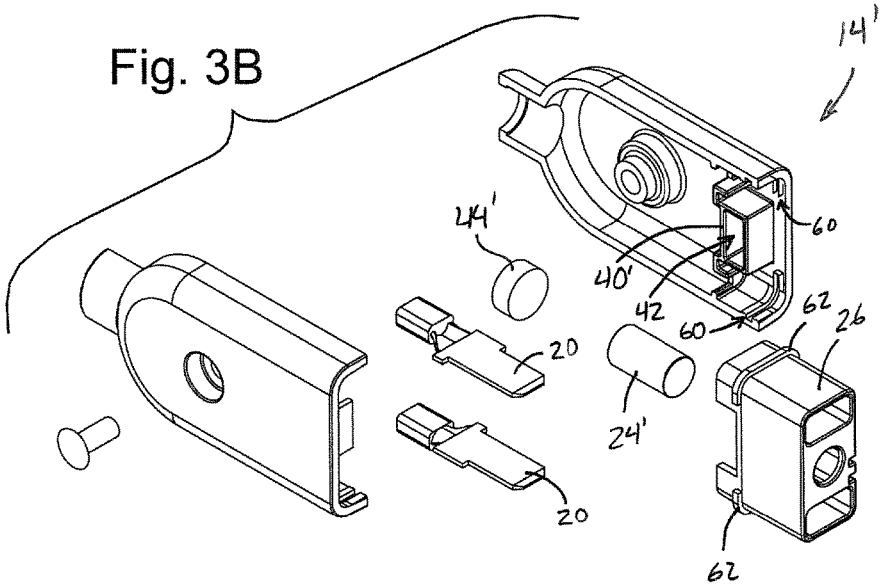
Figure 4A:
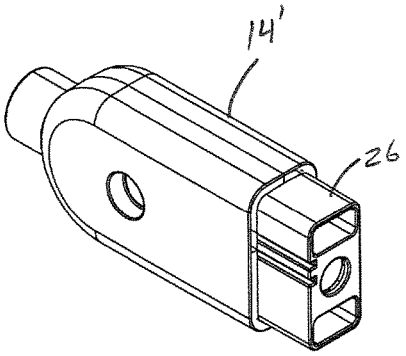
FIG. 4A is a perspective view of the alternative male connector part of FIGS. 3A and 3B.

Optionally, and with reference to FIGS. 3A and 3B, an alternative male connector part 14' is substantially similar to male connector part 14 described above, except that alternative male connector part 14' includes a rectangular interior housing 40' that both serves as a backstop for a sensory feedback member 24' and that also is sized and shaped to define an enclosed chamber 42' for containing a retraction element 44' in the form of a permanent magnet that retains sensory feedback member 24' in its retracted position when alternative male connector part 14' is not engaged with a compatible female connector part. In each of the above-described embodiments of female connector part 12 and the male connector parts 14, 14', it will be appreciated that the sensory feedback member 24, 24' is typically a ferrous material such as iron or steel that is readily attracted by a magnet, and that retraction element 44' and actuation element 38 are permanent magnets exhibiting lesser and greater magnetic field strengths, respectively.

However, it will be appreciated that the same effect may be achieved with different materials, such as if the sensory feedback member 24, 24' were itself a permanent magnet and the retraction element 44' and actuation element 38 were ferrous materials of different sizes or compositions so that the magnetic sensory feedback member 24, 24' is more strongly attracted to the actuation element 38 than it is to the retraction element 44'. It would also be possible for each of the sensory feedback member 24, 24', the retraction element 44', and actuation element 38 to be made from permanent magnet material, without departing from the spirit and scope of the present invention. Thus, each of these components may be described as comprising a magnetically permeable material, which refers to the material being either attracted or repelled by a magnet, or to the material itself having a magnetic field. It is also possible that a resilient spring or other form of biasing element may be substituted for the retraction element 44', so that the sensory feedback member 24, 24' can be retracted into male connector part 14, optionally without the presence of any permanent magnet in the male connector part 14.

It will further be appreciated that substantially the same effect may be achieved using repellant magnets as the sensory feedback member and actuation element. For example, a magnetic sensory feedback member may be drawn forwardly by a thin piece of ferrous material at a forward end of the male connector part, but may further be more strongly repelled by an actuation member in the female connector part, such that the sensory feedback member would be forced rearwardly inside of the male connector part when mated with the female connector part. In this way, the sensory feedback member may be completed obscured from view at all times, while reducing the risk that a contaminating material would contact and inhibit movement of the sensory feedback member. Moreover, it should be understood that the choice of positioning sensory feedback member 24 in male connector part 14, and positioning actuation element 38 in female connector part 12, is substantially arbitrary, and either connector part may contain the actuation element or the sensory feedback member. Thus, the principles of the present invention may be applied to androgynous connector parts, or may be positioned in any desired connector part that is compatible with another connector part.

Figure 5:
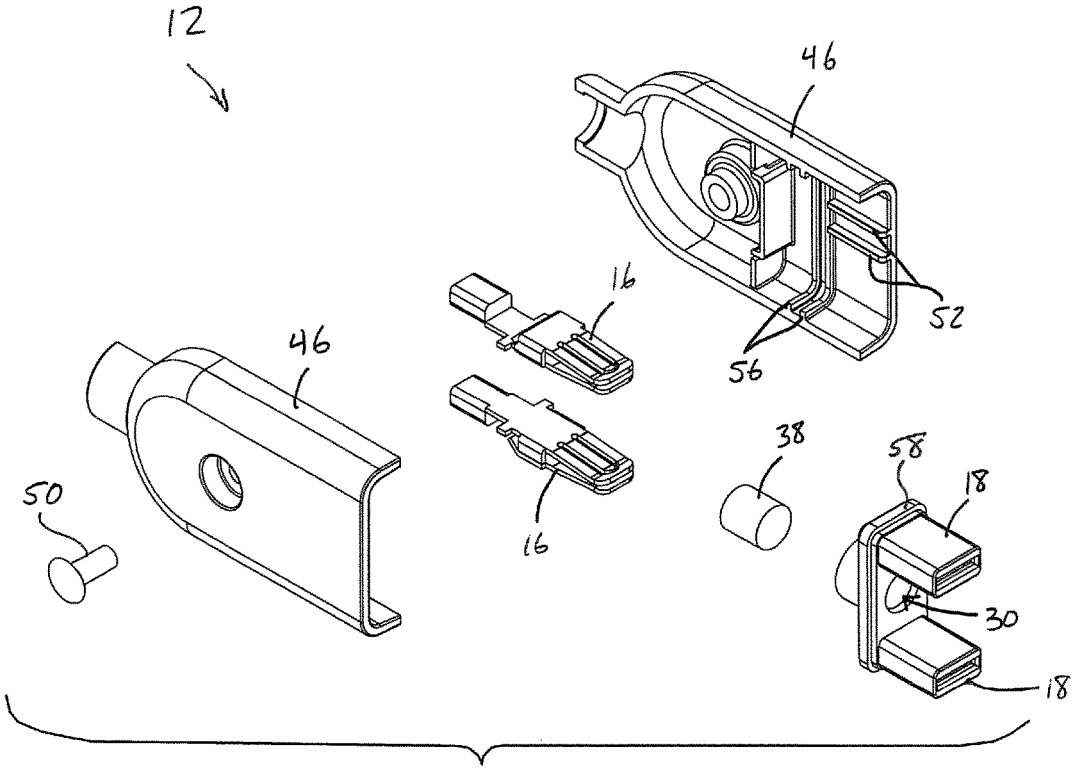
FIG. 5 is an exploded perspective view of the female connector part of the electrical connector.
Figure 6:
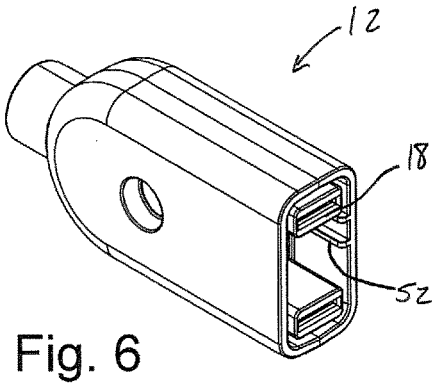
FIG. 6 is a perspective view of the female connector part of the electrical connector.
Figure 7:
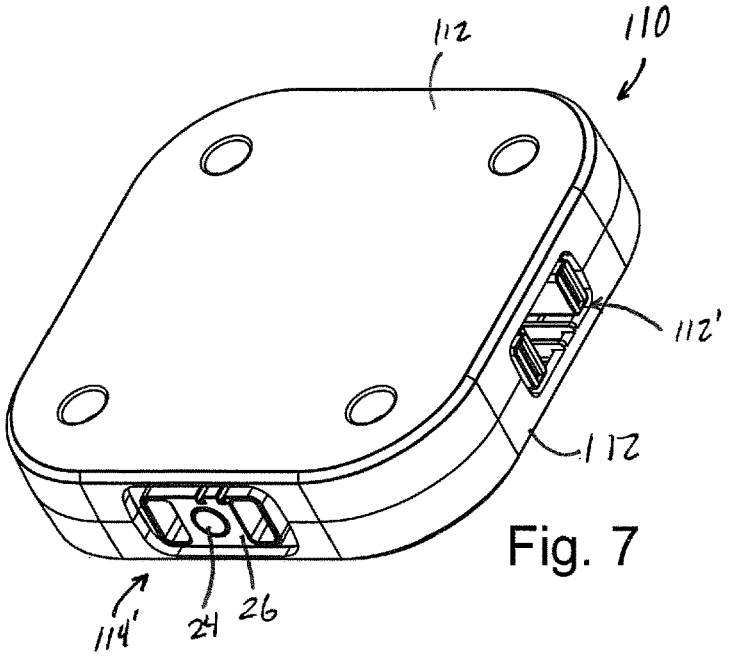
FIG. 7 is a perspective view of a three-outlet power distribution unit in accordance with the present invention.
Figure 8:
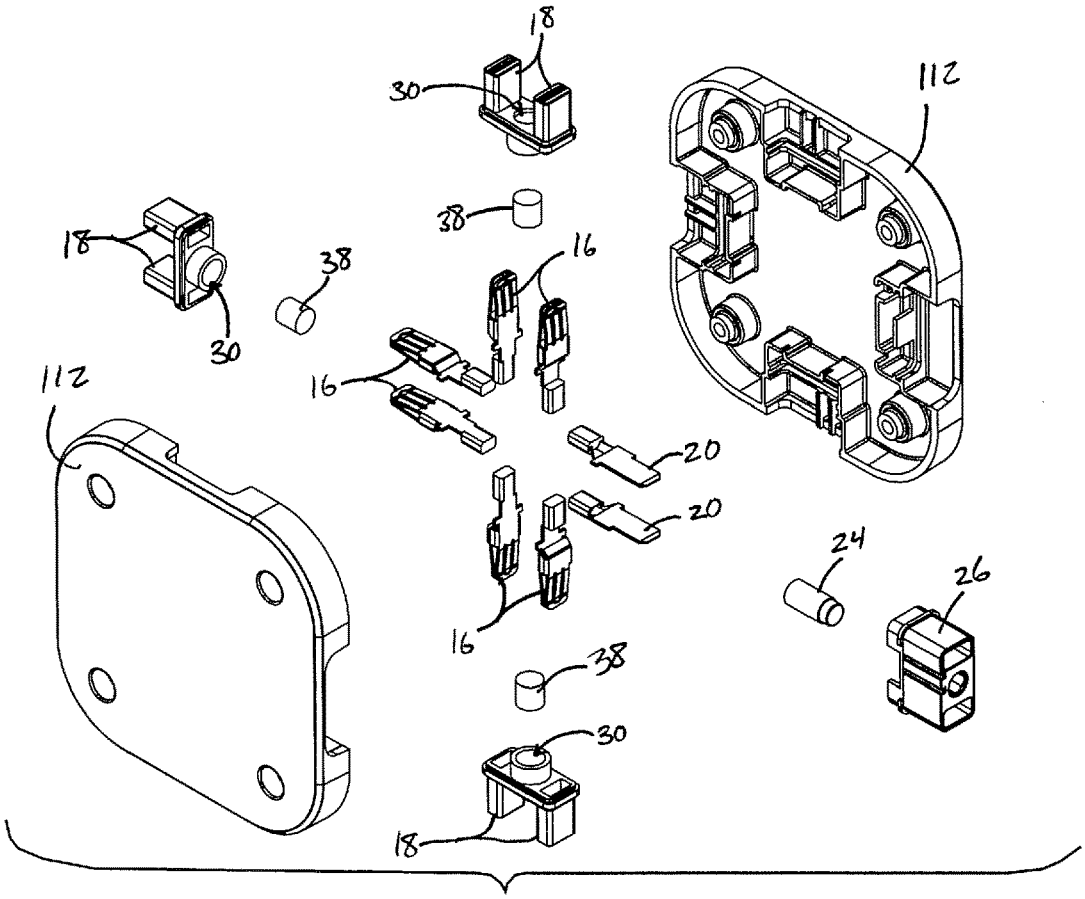
FIG. 8 is an exploded perspective view of the power distribution unit of FIG. 7.

In addition to the electrical contacts 16, 20, sensory feedback member 24, actuation element 38, and retraction element 44', each female connector part 12 includes a pair of housing pieces 46 made from insulative material and each male connector part includes a pair of housing pieces 48 made from insulative material, with the housing pieces 46, 48 assembling together around the other connector components and secured together with a mechanical fastener 50 such as a screw or rivet. Other fastening means are also envisioned including snap-together latch tabs, adhesives, ultrasonic welding, and the like. In the illustrated embodiment, one housing piece 46 of female connector part 12 includes a pair of ridges 52 that cooperate with a pair of grooves 54 formed in an outer surface of the male connector's sleeve 26 to ensure proper orientation of male connector part 14 with female connector part 12. Housing pieces 46 have a pair of internal ridges 56 along their interior surfaces that receive a flange 58 of an insulative body that forms both insulative contact housings 18 (FIG. 5), thereby retaining the contact housing 18 between housing pieces 46 when female connector 12 is assembled and secured. Similarly, housing pieces 48 define forward grooves 60 along their interior surfaces to receive flanges 62 of a body that forms sleeve 26 (FIGS. 3 and 3B), thereby retaining sleeve 26 between housing pieces 48 when male connector 14 is assembled and secured.

Figure 9:
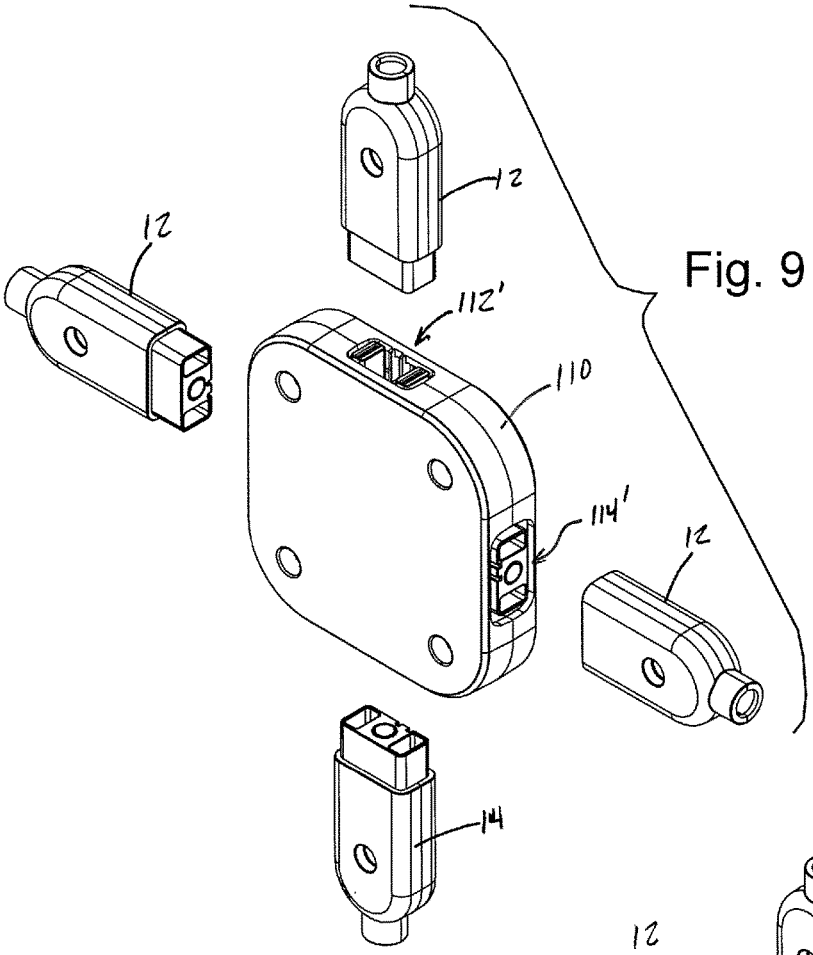
FIG. 9 is another perspective view of the power distribution unit of FIG. 7, showing four compatible electrical connectors in spaced relation.
Figure 10:
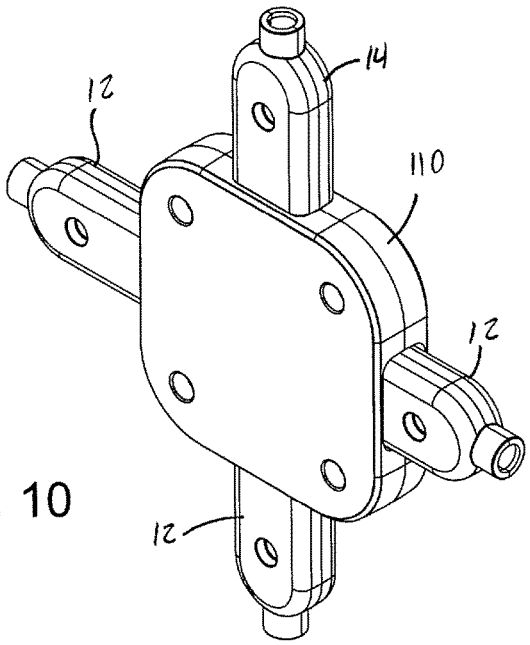
FIG. 10 is a perspective view of the power distribution unit and electrical connectors of FIG. 9, with the electrical connectors coupled to the power distribution unit.

The various features and advantages of connector 10 may be incorporated into a multi-port power distribution unit 110, such as shown in FIGS. 7-10. Power distribution unit 110 is assembled from two housing parts 112, which may be substantially identical to one another, and from other components that will be recognized as corresponding to components of the female and male connector parts 12, 14 described above. Essentially, power distribution unit 110 has four sides, each of which has internal shapes and contains components corresponding to the female connector part 12 or the male connector part 14. These components are assigned reference numerals in FIG. 8 that, for like components, correspond to the reference numerals used in connection with the female connector part 12 and the male connector part 14. These include female electrical contacts 16, male electrical contacts 20, a sensory feedback member 24, actuation elements 38, a sleeve 26, an insulative body forming insulative contact housings 18. Once assembled, multi-port power distribution unit 110 forms a male connector part 114' for receiving power or data signals from an outside source via a female connector part 12, and three female connector parts 112' for distributing the power or data signals to up to three different male connector parts 14, such as shown in FIGS. 9 and 10.

Figure 11:
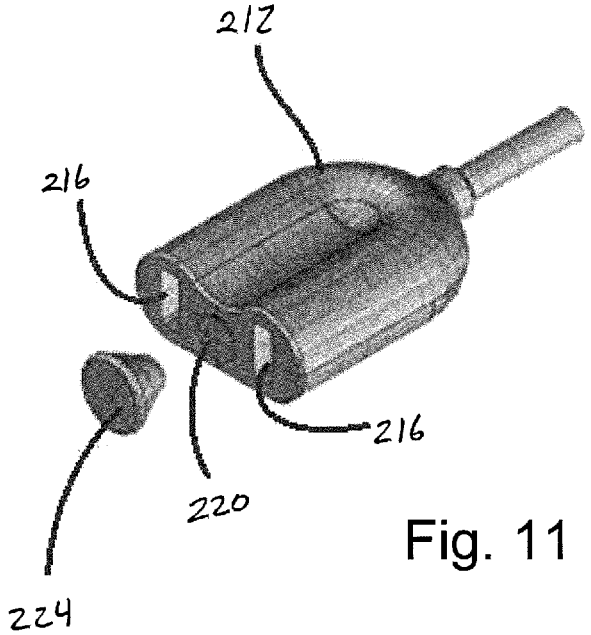
FIG. 11 is a perspective view of a female connector part and a frusto-conical magnet of a compatible male connector part in accordance with the present invention.
Figure 12:
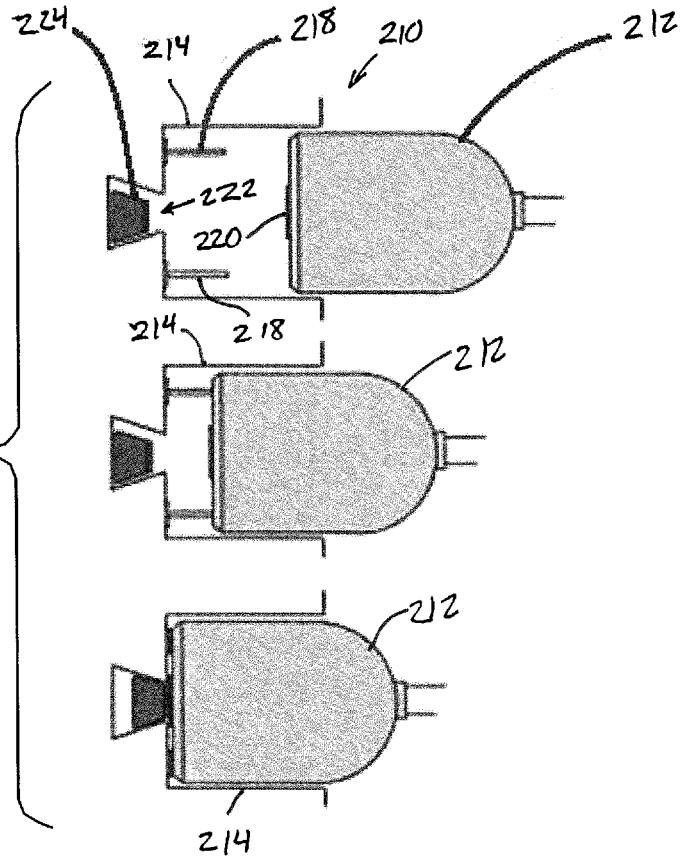
FIG. 12 is a series of three side elevation views of the female connector part engaging the compatible male connector part with frusto-conical magnet.

Optionally, and with reference to FIGS. 11 and 12, another electrical connector 210 provides sensory feedback with reduced parts count and complexity as compared to the connectors 10, 110 described above. Electrical connector 210 includes a female connector part 212 and a male connector part 214, the female connector part 212 having a pair of receptacle openings 216 and the male connector part 214 having a pair of corresponding prongs 218. Female connector part 212 further includes a centrally-located magnetically permeable actuation member 220 (magnet or magnetically-attractable material), and male connector part 212 has a centrally-located frusto-conical chamber 222 containing a frusto-conical sensory feedback member 224, the latter being undersized compared to the former.

Because of the respective shapes of frusto-conical chamber 222 and frusto-conical sensory feedback member 224, the sensory feedback member 224 will tend to fall toward the back of chamber 222 (as in the top and middle views of FIG. 12) under force of gravity when male connector part 214 is held at various angles ranging from horizontal (shown) to vertically upright (i.e., rotated 90-degrees counterclockwise from the horizontal orientation of FIG. 12), and also at some angles rotated down from horizontal (i.e., in the clockwise direction from the horizontal orientation of FIG. 12). However, it will be appreciated that sensory feedback member 224 will fall toward the open end of chamber 222 under force of gravity if male connector were oriented vertically down (i.e., rotated 90-degrees from the horizontal orientation of FIG. 12), unless a biasing member such as a spring were provided in chamber 222 to urge sensory feedback member 224 toward the rear of the chamber 222 with sufficient force to overcome gravity.

When female connector part 212 is aligned and engaged with male connector part 214, and the connector parts are pushed together by a sufficient amount, such as shown in the bottom view of FIG. 12, the sensory feedback member 224 will be drawn to the actuation member 220 and "snap" into engagement therewith, causing a tactile or haptic sensation (and optionally an audible sound) that provides a user with confirmation that the connector parts are adequately mated. Upon separation of the female connector part 212 from the male connector part 214, the magnetic interaction (attraction) between the sensory feedback member 224 and the actuation member 220 is reduced until the force of gravity (and/or the force of a retraction biasing element) is sufficient to cause the sensory feedback member 224 to fall back toward the rear of the chamber 222 (as in the top and middle views of FIG. 12).

Accordingly, the present invention provides a user with sensory feedback in the form of an audible sound and/or a vibration or similar haptic or tactile feedback that is sensed through the user's fingertips or hands, when the two connector parts are properly aligned and sufficiently engaged. Although it is envisioned that friction would be the primary force resisting separation of the two connector parts together, the magnetically permeable components of the feedback parts may provide additional retention and stabilizing.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. An electrical connector comprising:

a first connector part and a second connector part that are configured for mating engagement with one another, each connector part having at least one electrical contact;

a sensory feedback member mounted at the second connector part and movable between a retracted position and an extended position relative to the second connector part, wherein the sensory feedback member comprises a magnetically permeable material; and an actuation element at the first connector part and comprising a magnetically permeable material, wherein the actuation element and the sensory feedback member are magnetically interactive with one another;

wherein the actuation element is configured to force the sensory feedback member, by magnetic interaction, to move between the retracted position and the extended position upon mating engagement of the first and second connector parts.

2. The electrical connector of claim 1, wherein the sensory feedback member is configured to generate at least one of an audible sound and a tactile sensation, upon moving between the retracted position and the extended position.

3. The electrical connector of claim 1, wherein at least one of the actuation element and the sensory feedback member comprises a permanent magnet.

4. The electrical connector of claim 1, wherein the actuation element and the sensory feedback member each comprises a permanent magnet.

5. The electrical connector of claim 1, wherein the sensory feedback member is generally cylindrical and the second connector part comprises a generally cylindrical bore in which the sensory feedback member is slidably supported.

6. The electrical connector of claim 1, wherein the second connector part comprises a hollow chamber formed behind the actuation element for selectively receiving a rear portion of the actuation element in the retracted position.

7. The electrical connector of claim 1, further comprising a biasing member at a rear end of the hollow chamber in the second connector part, wherein the biasing member is configured to cause the sensory feedback member to move to the retracted position when the first and second connector parts are not mated.

8. The electrical connector of claim 7, wherein the biasing member comprises a permanent magnet.

9. The electrical connector of claim 8, wherein the actuation element comprises a permanent magnet, the actuation element has a greater magnetic field strength than a magnetic field strength of the biasing member, and the magnetic field strength of the actuation element is sufficient to overcome the magnetic field strength of the biasing member to move the sensory feedback member to the extended position upon mating of the connector parts.

10. The electrical connector of claim 1, wherein a forward surface of the sensory feedback member is substantially flush with a forward surface of the second connector part when the sensory feedback member is in the retracted position.

11. An electrical connector comprising:

first and second connector parts configured for mating engagement with one another, each connector part having an electrical contact configured for mutual engagement;

a magnetically permeable sensory feedback member mounted at the second connector part and movable between a retracted position and an extended position relative to the second connector part; and a magnetically permeable actuation element at the first connector part;

wherein at least one of the actuation element and the sensory feedback member comprises a permanent magnet, and the actuation element and the sensory feedback member are magnetically interactive;

wherein the actuation element is configured to force the sensory feedback member, by magnetic interaction, to move between the retracted position and the extended position upon at least initial mating engagement of the first and second connector parts; and wherein the sensory feedback member is configured to generate an audible sound or a tactile sensation, upon moving between the retracted position and the extended position.

12. The electrical connector of claim 11, wherein the actuation element is configured to force the sensory feedback member to move between the retracted position and the extended position only after the electrical contacts of the first and second connector parts establish electrical continuity during coupling of the first and second connector parts.

13. The electrical connector of claim 11, wherein the actuation element and the sensory feedback member each comprises a permanent magnet.

14. The electrical connector of claim 11, wherein the actuation element is disposed in a central region of the first connector part and the sensory feedback member is disposed in a central region of the second connector part, wherein the first connector part comprises a pair of the electrical contacts arranged on opposites sides of the actuation element and the second connector part comprises a pair of the electrical contacts arranged on opposites sides of the sensory feedback member.

15. The electrical connector of claim 11, wherein the sensory feedback member is generally cylindrical and the second connector part comprises a generally cylindrical bore in which the sensory feedback member is slidably supported.

16. The electrical connector of claim 11, wherein the second connector part comprises a hollow chamber formed behind the actuation element for selectively receiving a rear portion of the actuation element in the retracted position.

17. The electrical connector of claim 16, further comprising a biasing member at a rear end of the hollow chamber in the second connector part, wherein the biasing member is configured to cause the sensory feedback member to move to the retracted position when the first and second connector parts are not mated.

18. The electrical connector of claim 17, wherein the biasing member comprises a permanent magnet.

19. The electrical connector of claim 18, wherein the actuation element comprises a permanent magnet, the actuation element has a greater magnetic field strength than a magnetic field strength of the biasing member, and the magnetic field strength of the actuation element is sufficient to overcome the magnetic field strength of the biasing member to move the sensory feedback member to the extended position upon mating of the connector parts.

20. The electrical connector of claim 11, wherein a forward surface of the sensory feedback member is substantially flush with a forward surface of the second connector part when the sensory feedback member is in the retracted position.

* * * * *